US008713978B2

(12) United States Patent
Schmidt et al.

(10) Patent No.: US 8,713,978 B2
(45) **Date of Patent: *May 6, 2014**

(54) COMBINATION DISCUS LOCK ASSEMBLY AND METHODS OF USING THE SAME

(71) Applicant: Wordlock, Inc., Santa Clara, CA (US)

(72) Inventors: Peter Schmidt, San Jose, CA (US); Kurt Kemppainen, Mound, MN (US)

(73) Assignee: Wordlock, Inc., Santa Clara, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/789,301

(22) Filed: Mar. 7, 2013

(65) Prior Publication Data

US 2013/0312465 A1 Nov. 28, 2013

Related U.S. Application Data

(63) Continuation of application No. 13/246,722, filed on Sep. 27, 2011, now abandoned, which is a continuation-in-part of application No. 12/857,176, filed on Aug. 16, 2010, now Pat. No. 8,393,186.

(60) Provisional application No. 61/249,165, filed on Oct. 6, 2009.

(51) Int. Cl.
*E05B 37/02* (2006.01)

(52) U.S. Cl.
USPC ..... 70/22; 70/25; 70/40; 70/52; 70/53; 70/445

(58) Field of Classification Search
USPC ..... 70/22, 24, 25, 40, 48, 52, 445, 446, 51, 70/53, 129; D8/331, 333–335, 339, 341
See application file for complete search history.

(56) References Cited

U.S. PATENT DOCUMENTS

| | | | | | |
|---|---|---|---|---|---|
| 221,258 | A | * | 11/1879 | Walker | 70/25 |
| 229,332 | A | * | 6/1880 | Pease | 70/40 |
| 255,164 | A | * | 3/1882 | Grout | 70/25 |
| 304,203 | A | * | 8/1884 | Joerden | 70/129 |
| 486,666 | A | * | 11/1892 | Deal | 70/25 |
| 596,596 | A | * | 1/1898 | Johnson | 70/25 |
| 1,117,417 | A | * | 11/1914 | Meepos | 70/29 |
| 1,172,970 | A | * | 2/1916 | Fowler | 70/27 |
| 1,571,281 | A | * | 2/1926 | La Port | 70/25 |
| 1,942,454 | A | * | 1/1934 | Samburg | 70/25 |
| 2,647,390 | A | * | 8/1953 | Paulson | 70/227 |
| 3,115,028 | A | * | 12/1963 | Windle | 70/288 |
| 3,260,079 | A | * | 7/1966 | Caskey | 70/25 |
| 3,487,666 | A | * | 1/1970 | Richards, Jr. | 70/150 |

(Continued)

*Primary Examiner* — Lloyd Gall
(74) *Attorney, Agent, or Firm* — Lucas & Mercanti, LLP

(57) ABSTRACT

The present disclosure describes combination discus locks and associated methods. A lock device configured in accordance with a particular embodiment of the present disclosure includes a discus lock housing, a locking mechanism positioned in the lock housing, and a plurality of rotatable wheels operably coupled to the locking mechanism. The rotatable wheels can individually have a plurality of indicia used to display a combination. The locking mechanism can be configured to move from a locked configuration to an unlocked configuration when the combination is displayed. The lock device can further include a shackle and a slider actuator positioned on an outer surface of the lock housing. The slider actuator can be operably coupled to the shackle and to the locking mechanism, and can be configured to drive the shackle from a closed position to an open position when the locking mechanism is in the unlocked configuration.

10 Claims, 9 Drawing Sheets

(56) References Cited

U.S. PATENT DOCUMENTS

| | | | | | |
|---|---|---|---|---|---|
| 3,621,683 | A | * | 11/1971 | Mann | 70/70 |
| 3,633,388 | A | * | 1/1972 | Atkinson | 70/80 |
| 5,444,999 | A | * | 8/1995 | Hsiao | 70/247 |
| 5,765,409 | A | * | 6/1998 | Yang | 70/28 |
| 5,839,301 | A | * | 11/1998 | Hsu | 70/25 |
| D407,294 | S | * | 3/1999 | Chen | D8/334 |
| 5,901,587 | A | * | 5/1999 | Chen | 70/28 |
| 5,918,489 | A | * | 7/1999 | Yang | 70/28 |
| 5,921,123 | A | * | 7/1999 | Schwarzkopf et al. | 70/371 |
| D426,763 | S | * | 6/2000 | Adler et al. | D8/334 |
| D428,398 | S | * | 7/2000 | Coleman | D14/486 |
| D428,794 | S | * | 8/2000 | Fiegener et al. | D8/334 |
| D439,823 | S | * | 4/2001 | Adler et al. | D8/334 |
| 6,263,758 | B1 | * | 7/2001 | Kumamoto et al. | 74/513 |
| 6,363,758 | B1 | * | 4/2002 | Ling | 70/30 |
| 6,470,718 | B1 | * | 10/2002 | Yang | 70/30 |
| D486,721 | S | * | 2/2004 | Ling | D8/334 |
| 6,955,069 | B2 | * | 10/2005 | Segawa et al. | 70/208 |
| D513,582 | S | * | 1/2006 | Osiecki et al. | D8/343 |
| D524,632 | S | * | 7/2006 | Kearns et al. | D8/334 |
| D541,630 | S | * | 5/2007 | Blomstrom | D8/334 |
| D542,625 | S | * | 5/2007 | Blomstrom et al. | D8/334 |
| 7,222,506 | B2 | * | 5/2007 | Yu | 70/21 |
| 7,370,498 | B1 | * | 5/2008 | Miao | 70/21 |
| 7,415,850 | B2 | * | 8/2008 | Smyczek et al. | 70/51 |
| D638,685 | S | | 5/2011 | Schmidt et al. | |
| D649,013 | S | | 11/2011 | Schmidt et al. | |
| D662,395 | S | | 6/2012 | Schmidt et al. | |
| 8,347,660 | B2 | * | 1/2013 | Guenther | 70/52 |
| D678,037 | S | * | 3/2013 | Schmidt et al. | D8/334 |
| 8,393,186 | B2 | * | 3/2013 | Schmidt et al. | 70/22 |
| D688,113 | S | * | 8/2013 | Schmidt et al. | D8/334 |
| 2008/0053167 | A1 | * | 3/2008 | Basche | 70/22 |
| 2012/0131965 | A1 | | 5/2012 | Schmidt et al. | |
| 2012/0167641 | A1 | * | 7/2012 | Guenther | 70/52 |
| 2013/0205844 | A1 | * | 8/2013 | Lai | 70/25 |

* cited by examiner

COMBINATION DISCUS LOCK ASSEMBLY AND METHODS OF USING THE SAME

CROSS-REFERENCE TO RELATED APPLICATIONS

This application is a continuation of U.S. patent application Ser. No. 13/246,722, filed Sep. 27, 2011, and entitled COMBINATION DISCUS LOCK ASSEMBLY AND METHODS OF USING THE SAME, now abandoned, which is a continuation-in-part of U.S. patent application Ser. No. 12/857,176, filed Aug. 16, 2010, and entitled COMBINATION DISCUS LOCK ASSEMBLY AND METHODS OF USING THE SAME, now granted U.S. Pat. No. 8,393,186, issued Mar. 12, 2013, which claims priority to and the benefit of U.S. Provisional Patent Application No. 61/249,165, filed Oct. 6, 2009, and entitled COMBINATION DISCUS LOCK ASSEMBLY AND METHOD OF USING THE SAME, all of which are incorporated herein by reference in their entirely.

TECHNICAL FIELD

The present invention relates to lock devices and locking methods. In particular, the present invention relates to a combination lock assembly and a locking method using the combination lock assembly.

BACKGROUND

Locks are commonly used for securing a wide variety of objects. For instance, locks are frequently used to secure lockers, toolboxes, luggage, bags, gates, doors, containers, bicycles, vehicles and the like. One main disadvantage of a key-based lock is that a physical key is required to open the lock. A key to a lock may often be misplaced, may be cumbersome to carry, and may be difficult to remember. Another disadvantage of a key-based lock is that a user typically cannot reset or change the key configuration without also replacing the lock.

Conventional discus locks are typically locked and unlocked with a key, and the key is used to move the lock's shackle between open and closed positions. Due to the above mentioned disadvantages, it is desirable to provide a key-less, resettable, combination-style discus lock.

SUMMARY

The present invention provides a discus lock and related methods that overcome drawbacks experienced in the prior art and provide other benefits. Embodiments in accordance with the present disclosure are directed generally toward discus-style combination locks bearing at least one of alphabetic characters, numeric characters, symbols and blanks on a plurality of engagement members.

In at least one embodiment, a combination discus lock having an actuator that can be manipulated by a user to move the lock's locking member, e.g., a shackle, between open and closed positions when the lock's locking device is in an unlocked configuration. The discus lock has one or more engagement members with associated indicia, such as selected letters thereon. The engagement members are coupled to the locking device and can be moved by a user to a selected combination that unlocks the locking device, thereby allowing the actuator to move the locking member between the closed position to the open position. In one embodiment, the engagement members include a plurality of rotatable wheels adjacent to each other. The wheels each include a plurality of letters thereon, such that the wheels can be rotated and manipulated to align letters to spell one or more words, which can be the combination for the locking mechanism. The wheels can be arranged so the adjacent letters or other indicia are aligned generally transverse to an axis extending between the top and bottom of the lock. Accordingly, when the lock is arranged with the top vertically above the bottom, the letters across the wheels will be arranged generally horizontally.

The discus lock, in at least one embodiment, is resettable so that the combination of the lock may be changed. A reset mechanism can include a manually manipulated reset member, such as an actuator with a slot that allows the user to engage and move (e.g. rotate) the member. The reset member can be moved between a set position wherein the combination is set, and a reset position wherein the combination is not set and a user can change the combination to a different combination before moving the member back to the set position.

In one embodiment, a combination discus lock device is provided that comprises a discus lock housing and a locking mechanism positioned at least partially within the housing. The locking mechanism has a locked position and an unlocked position. A plurality of engagement members are coupled to the locking mechanism and are moveable relative to the housing. The engagement members include indicia thereon and are configurable to display with the indicia combination to unlock the locking mechanism. When the combination is displayed the locking mechanism is moveable from the locked position to the unlocked position, and when the combination is not displayed the locking mechanism is blocked from moving to the unlocked position. A shackle is connected to the housing and coupled to the locking mechanism. The shackle is moveable relative to the housing between open and closed positions. The shackle is movable to the open position when the locking mechanism is in the unlocked position and when the combination is displayed, and the shackle is retained in the closed position when the locking mechanism is in the locked position. An actuator is coupled to the locking mechanism and to the shackle. A portion of the actuator is exterior of the housing and is manually engageable by a user. The actuator is moveable relative to the housing between first and second positions causing the shackle to move between the closed and open positions. The actuator is free to move from the first position to the second position when the locking mechanism is in the unlocked position, and the actuator is restricted from moving to the second position when the locking mechanism is in the locked position.

In another embodiment, a combination discus lock device comprises a discus lock housing and a locking mechanism positioned at least partially within the housing and having a locked position and an unlocked position. A plurality of engagement members are coupled to the locking mechanism and are moveable relative to the housing. The engagement members including indicia thereon and are configurable to display with the indicia a combination to unlock the locking mechanism. When the combination is displayed the locking mechanism is moveable from the locked position to the unlocked position, and when the combination is not displayed the locking mechanism is blocked from moving to the unlocked position. A shackle is connected to the housing and coupled to the locking mechanism. The shackle is moveable relative to the housing between open and closed positions. The shackle is movable to the open position when the locking mechanism is in the unlocked position and when the combination is displayed. The shackle is retained in the closed position when the locking mechanism is in the locked position. An actuator is coupled to the locking mechanism and to the shackle. A portion of the actuator is exterior of the housing and is manually engageable by a user. The actuator is moveable relative to the housing between first and second positions causing the shackle to move between the closed and open positions. The actuator is free to move from the first position to the second position when the locking mechanism is in the unlocked position. The actuator is restricted from moving to the second position when the locking mechanism is in the locked position.

In another embodiment, a combination discus lock device comprises a lock housing and a locking mechanism positioned at least partially within the lock housing, wherein the locking mechanism has a locked configuration and an unlocked configuration. A rotatable engagement member is operably coupled to the locking mechanism. The engagement member configured to display a combination, wherein the locking mechanism is in the unlocked configuration when the combination is displayed, and wherein the locking mechanism is in the locked configuration when the combination is not displayed. A shackle has open and closed positions. When the shackle is in the closed position, a portion of the shackle is releasably engaged within the lock housing. When the shackle is in the open position, the portion of the shackle is released and is moveable relative to the housing. A slider actuator is operably coupled to the shackle and to the locking mechanism. The slider actuator is slideable relative to the housing between a first position and a second position spaced apart from the first position, wherein moving the slider actuator to the second position when the locking mechanism is in the unlocked configuration moves the shackle from the closed position to the open position.

In yet another embodiment, a combination lock device comprises a discus lock housing, and a locking mechanism positioned within the lock housing. The locking mechanism has a locked configuration and an unlocked configuration. A plurality of rotatable wheels are operably coupled to the locking mechanism. The rotatable wheels individually having sets of indicia, a predetermined subset of the indicia corresponding to a combination, wherein the locking mechanism is configured to move from the locked configuration to the unlocked configuration when the combination is displayed on the wheels. A shackle has an open position and a closed position. A slider actuator is positioned on an outer surface of the discus lock housing and is operably coupled to the shackle and to the locking mechanism. The slider actuator is configured to move the shackle from the closed position to the open position when the locking mechanism is in the unlocked configuration.

Another embodiment provides a method of operating a combination discus lock device. The method comprises engaging a combination discus lock device having a lock body. The lock body contains a lock mechanism, and a plurality of wheels coupled to the lock mechanism and configured to display indicia representing an unlocking combination. A shackle is coupled to the lock mechanism, and an actuator is coupled to the lock mechanism. The shackle has an open position and a closed position. In the open position a portion of the shackle is disengaged from the lock body, and in the closed position the portion of the shackle is engaged with the lock body and the locking mechanism prevents the shackle from moving to the open position. The method also includes rotating the plurality of wheels to display the unlocking combination, wherein the unlocking combination is configured to position the wheels relative to the locking mechanism to allow the locking mechanism to move from a locked position to an unlocked position. The method also includes manually moving the actuator from a first position to a second position when the combination is displayed causing the shackle to move from the closed position to the open position.

Yet another embodiment provides a method of making a combination discus lock device. The method comprises providing a discus lock body and a locking mechanism positioned at least partially within the lock body. The locking mechanism has a locked position and an unlocked position. The method includes operably connecting a plurality of engagement members to the locking mechanism. The engagement members are configured to display a combination that allows the locking mechanism to move from the locked position to the unlocked position. The method includes operably coupling an actuator to the locking mechanism, wherein at least a portion of the actuator is exterior of the discus lock body and is moveable relative to the locking mechanism between first and second positions. The method includes operably coupling a shackle to the actuator, and releasably connecting at least a portion of the locking member to the lock body. The locking member has an open position and a closed position. In the closed position the combination is not displayed and the shackle is securely connected to the lock body, and in the open position the combination is displayed and at least a portion of the shackle is disengaged from the lock body. In the unlocked position the actuator is manually manipulatable to move the shackle from the closed position to the open position.

Another embodiment of the invention provides a method of making a combination lock device, comprising providing a discus lock housing and a locking mechanism positioned at least partially within the lock housing. The locking mechanism has a locked configuration and an unlocked configuration. The method includes operably coupling a plurality of rotatable engagement members to the locking mechanism. The engagement members are positionable to display a combination that allows the locking mechanism to move between the locked configuration and the unlocked configuration. The method includes coupling a shackle to the lock housing, wherein the shackle has a free end portion releasably engaged in the housing when the locking mechanism is in the locked configuration. The method also includes operably coupling a slider actuator to the locking mechanism and to the shackle. The slider actuator is positioned adjacent to the lock housing and is slideably movable from a first position to a second position spaced apart from the first position. Moving the slider actuator toward the second position moves the shackle to an open position relative to the lock housing when the locking mechanism is in the unlocked position.

DETAILED DESCRIPTION

The following describes embodiments of combination discus locks and methods of using and manufacturing the locks in accordance with the present disclosure. Embodiments of combination discus locks can include, but are not limited to padlocks, luggage locks, bike locks, and cable locks. Embodiments of the present disclosure can also include different lock shapes including, but not limited to discs, spheres, cylinders, cones, hexahedrons, and any other suitable shape. Embodiments in accordance with the present disclosure are set forth hereinafter to provide a thorough understanding and enabling description of a number of particular embodiments. Numerous specific details of various embodiments are described below with reference to discus-style combination locks having alphabetical characters or symbolic characters, but embodiments can be used with other locks and with other indicia. In some instances, well-known structures or operations are not shown, or are not described in detail to avoid obscuring aspects of this invention. A person skilled in the art will understand, however, that the invention may have additional embodiments, or that the invention may be practiced without one or more of the specific details of the embodiments as shown and described.

FIGS. 1-7 are described below and include numerous details. However, it should be noted that these embodiments are only examples of locks in accordance with the present disclosure. For example, FIGS. 1-7 show engagement members, capable of displaying a combination, as a plurality of wheels 101. However, other types of engagement members capable of displaying a combination may be used in accordance with the disclosed lock device. The actuator is described below as a lever 103, and may also have various embodiments including, but not limited to a switch, a button, and a dial.

Figure 1:
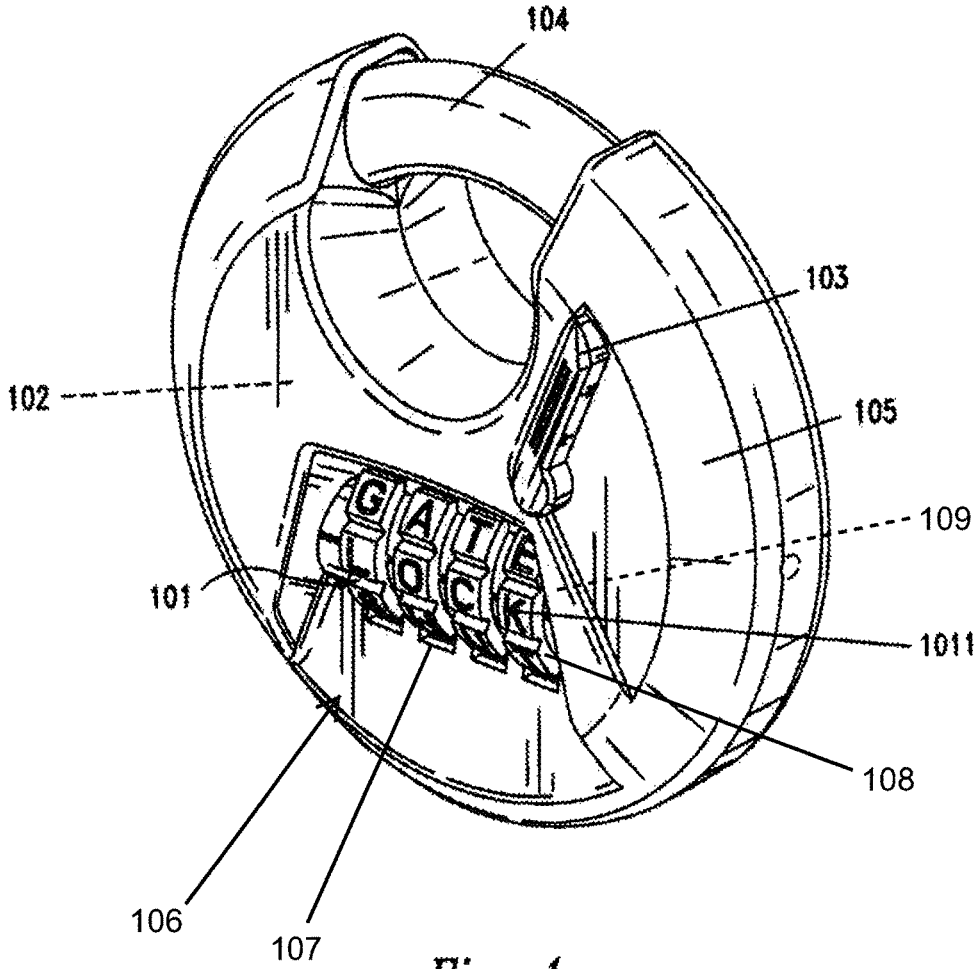
FIG. 1 is a perspective view showing a locked configuration of a combination discus lock in accordance with an embodiment of the present disclosure.
Figure 2:
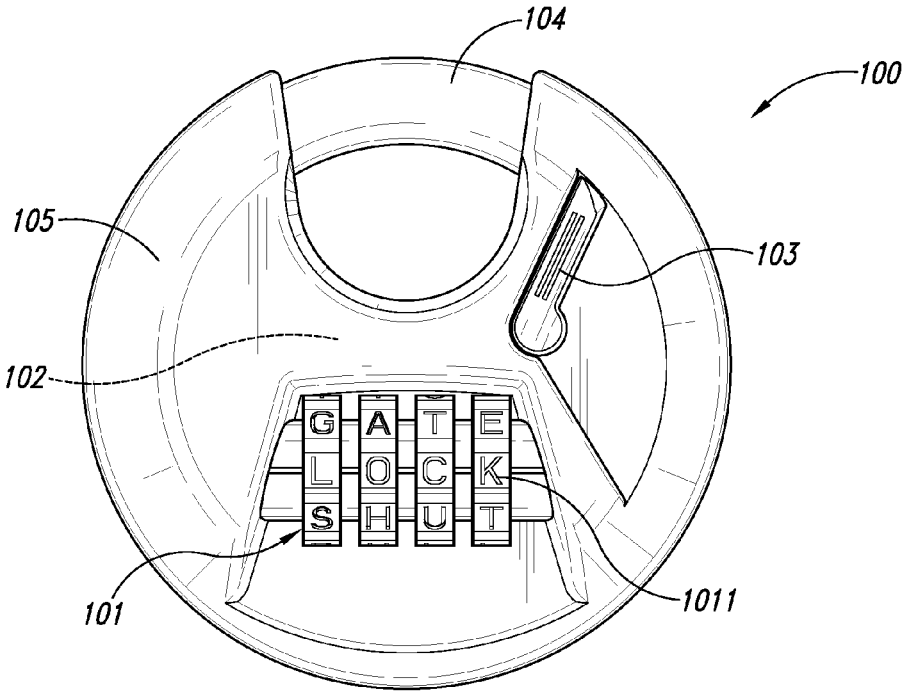
FIG. 2 is a front view showing a locked configuration of the combination discus lock shown in FIG. 1.

FIG. 1 shows an embodiment of a discus lock device 100 including a plurality of wheels 101, a housing 105, a locking mechanism 102 (shown in phantom lines, located within the housing 105), a lever 103, and a shackle 104. The locking mechanism 102 is disclosed in Chinese patent 2010201409997, filed Mar. 25, 2010, and is herein incorporated by reference in its entirety. The wheels 101 each include a plurality of indicia, such as letters 1011, disposed about each wheel 101. In this embodiment, the letters 1011 or other the indicia 1011 on the adjacent wheels 101 are arranged side-by-side so the wheels can be positioned to display a combination with letters. The housing 105 has a recessed area 106 in a front portion of the housing and an aperture 107 in the recessed area 106. The wheels 101 are disposed in the recessed area, wherein the recessed area is sized to allow a user to manually engage and move the wheels relative to the housing. The wheels 101 are coupled to the locking mechanism 102 and are individually rotatable with respect to the housing 105. The wheels 101 of the illustrated embodiment have a first portion 109 contained within the housing, and a second portion 108 of the wheels protrude through the aperture 107 in the recessed area 106. Accordingly, the user can rearrange the wheels to or from the unlocking combination by rotating wheels 101. In this illustrated embodiment, the lock device 100 is shown oriented with the top of the lock vertically disposed above the bottom of the lock, so that the adjacent letters on the wheels 101, which may or may not be the unlocking combination, are displayed generally horizontally, relative to the orientation of the lock device 100. This horizontal orientation of the letters 1011 makes the lock easier to read by the user. However, the wheels 101 may have several other orientations in relation to the locking device, including, but not limited to vertical, diagonal, and staggered. Additionally, the number of wheels 101 may vary depending upon the locking device 100. Greater numbers of wheels 101 create a higher number of possible combinations.

In FIG. 1, the locking mechanism 102, located within the housing 105, is coupled to the wheels 101 and to the lever 103. The lever 103 is further coupled to the shackle 104. In this embodiment, the housing 105 accommodates the locking mechanism 102, a portion of the lever 103, a portion of the wheels 101, and a portion of the shackle 104. However, in other embodiments different portions of the locking mechanism, lever, wheels, and shackle may be contained within the housing. In one embodiment, the locking device 100 is configured so a user can rotate the wheels 101 to align the letters 1011 to correspond to the unlocking combination of the locking device. This arrangement of the wheels positions the locking mechanism in an unlocked position, thereby providing an openable mode (such as the combination of "LOCK" shown in FIG. 1). In this arrangement, the locking mechanism 102 allows the lever 103 to be pivoted, moved, or otherwise activated, thereby moving the shackle 104 from a closed, locked position to an open, unlocked position. Once the wheels are positioned so the combination is not aligned and the locking mechanism is not in the openable mode (such as when the aligned letters are not shown as "LOCK" in FIG. 1), the locking mechanism is in a locked position and the shackle 104 remains closed. The lever 103 may be immobile when the locking mechanism 102 is in the locked position. In a different embodiment, the lever 103 may be manipulatable, but not engage the shackle until the locking mechanism 102 is in the unlocked position.

Figure 3:
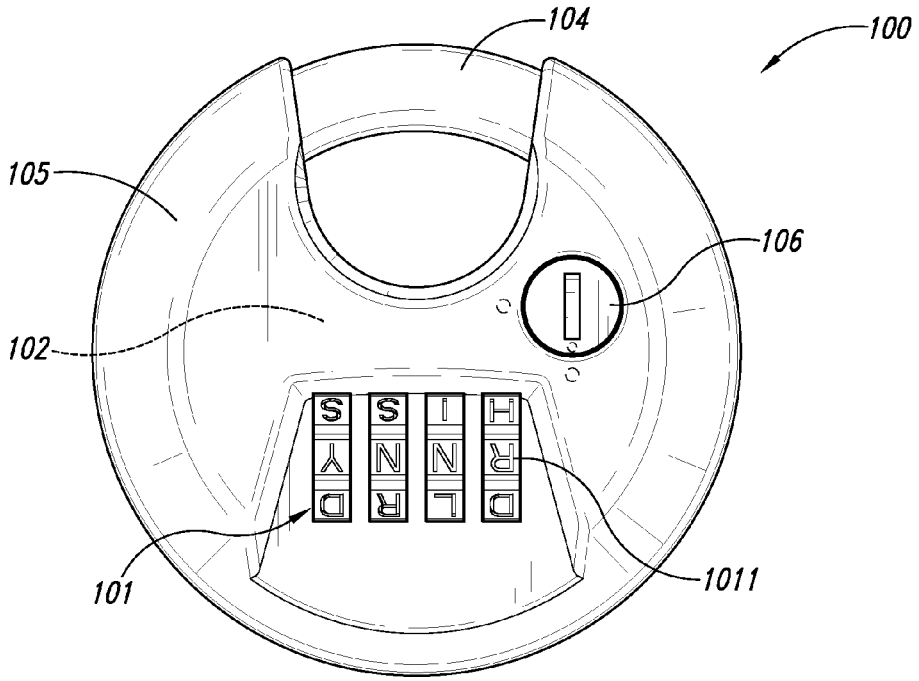
FIG. 3 is a back view showing a locked configuration of the combination discus lock shown in FIG. 1.
Figure 4:
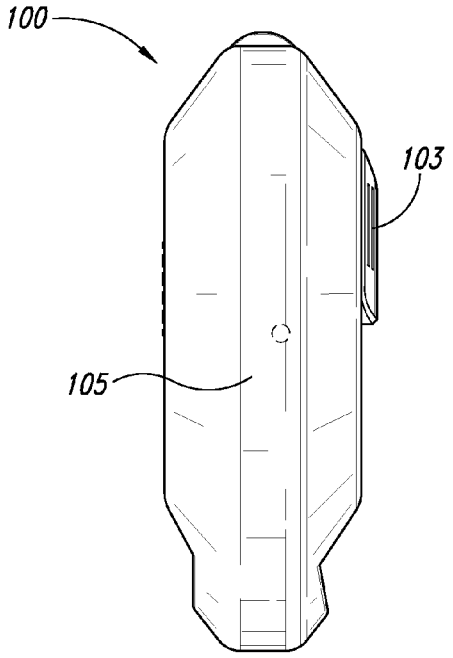
FIG. 4 is a right side view showing a locked configuration of the combination discus lock shown in FIG. 1.
Figure 5:
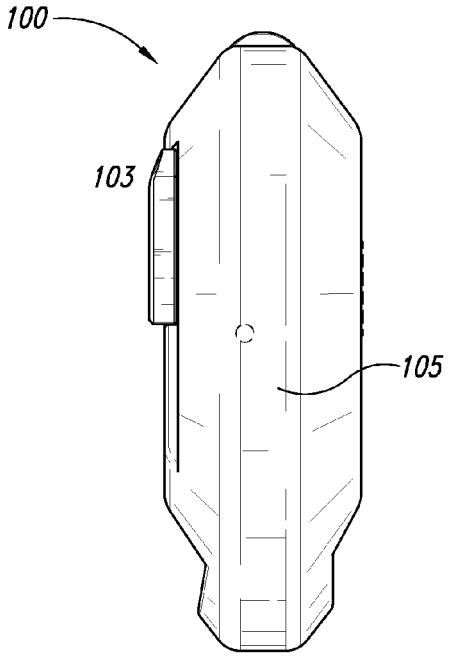
FIG. 5 is a left side view showing a locked configuration of the combination discus lock shown in FIG. 1.
Figure 6:
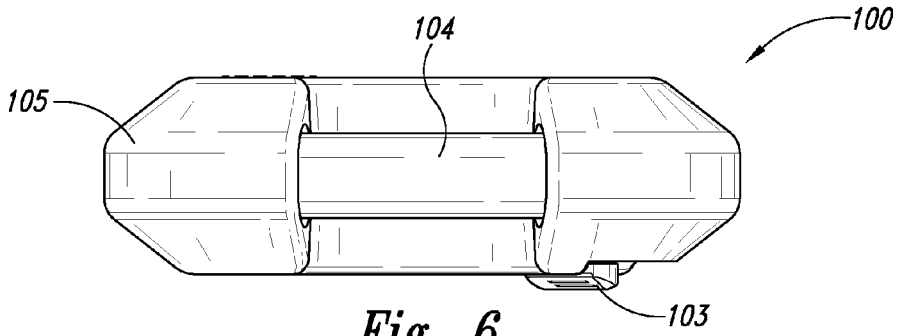
FIG. 6 is a top view showing a locked configuration of the combination discus lock shown in FIG. 1.
Figure 7:
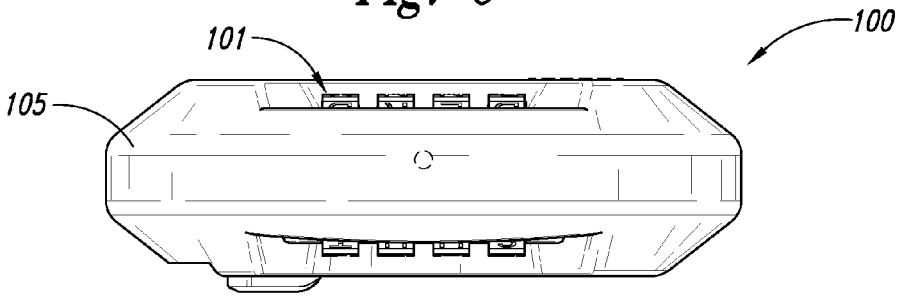
FIG. 7 is a bottom view showing a locked configuration of the combination discus lock shown in FIG. 1.
Figure 8:
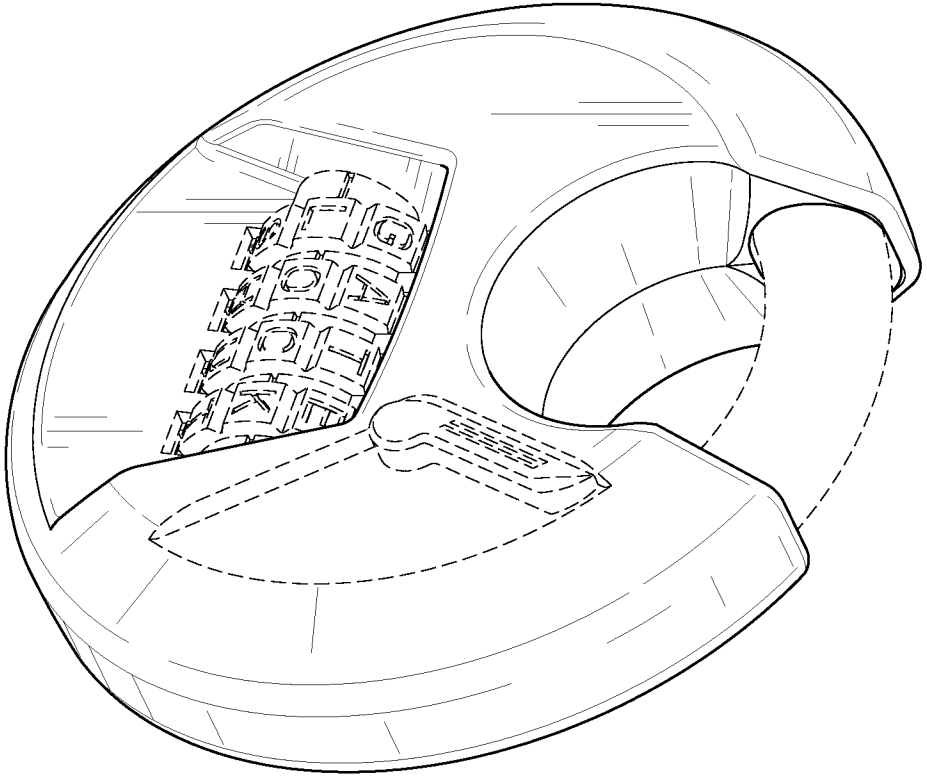
FIGS. 8-14 are views of a design of a combination discus lock in accordance with an embodiment of the present disclosure.
Figure 9:
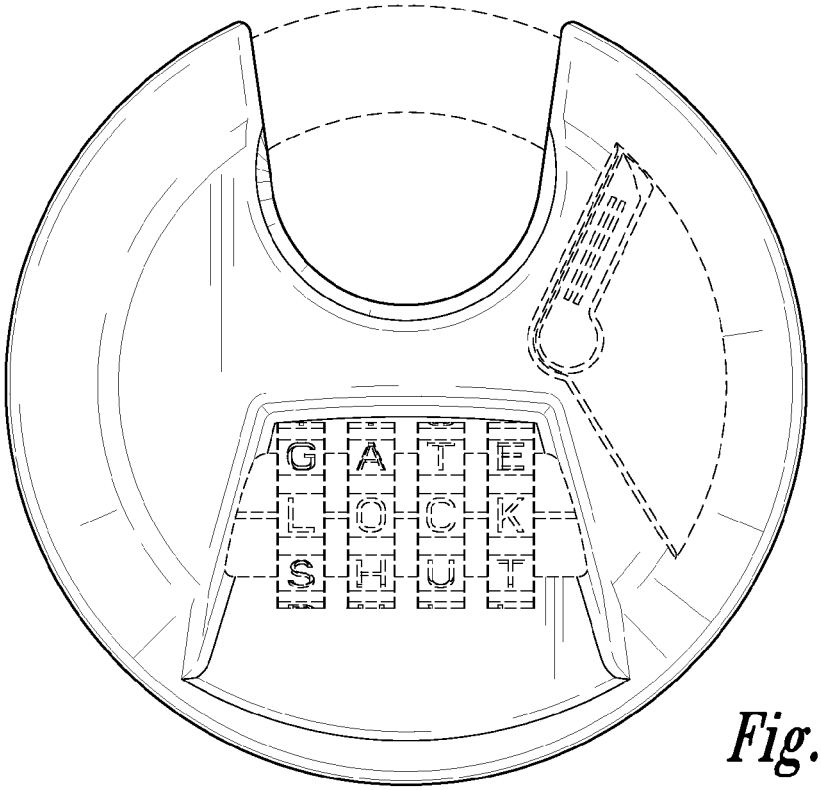
Figure 10:
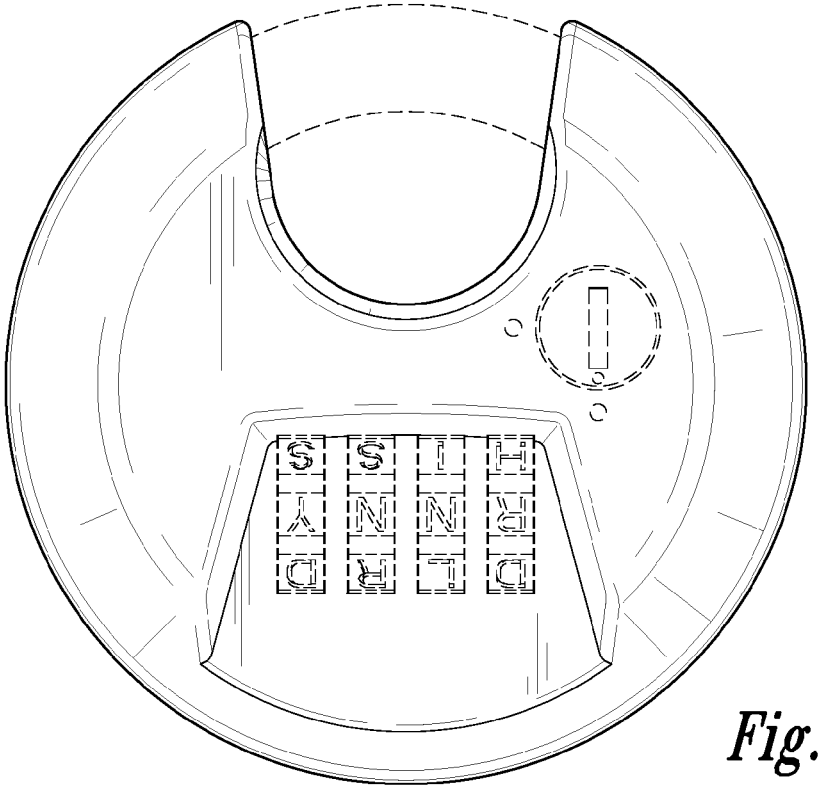
Figure 11:
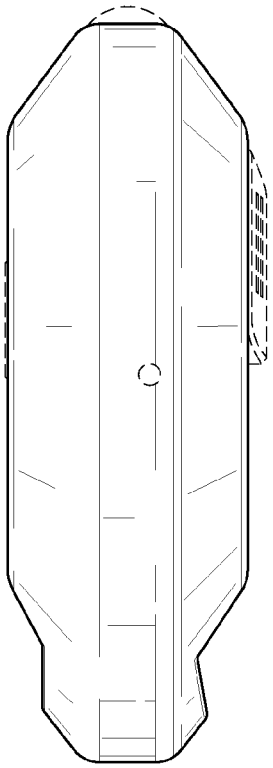
Figure 12:
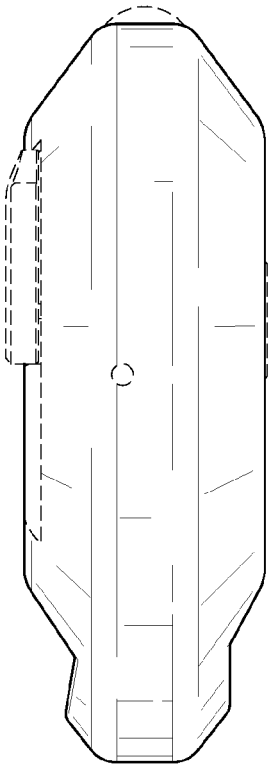
Figure 13:
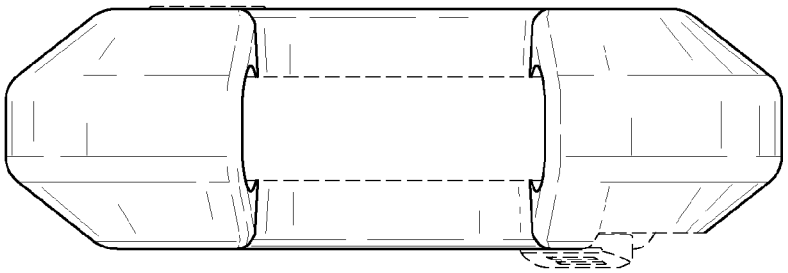
Figure 14:
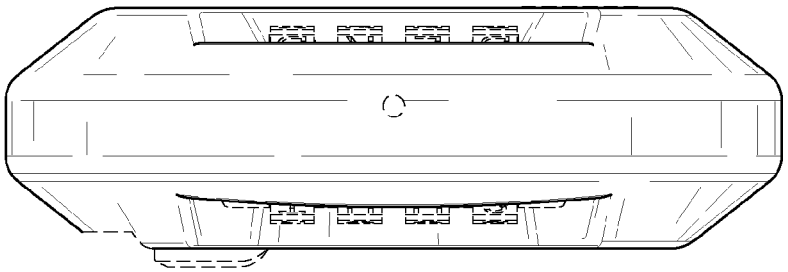

In at least one embodiment, the lock device 100 is resettable, such that a user can change or "re-set" the combination of the locking mechanism 102 that allows the locking mechanism to move from the locked position to the unlocked position. As shown in FIG. 3, the lock device 100 has a reset mechanism 106 coupled to the locking mechanism 102. In the illustrated embodiment, the reset mechanism 106 is accessible from, as an example, the back of the housing. The reset mechanism 106 may be in other locations on the lock device 100, such as the front, side, or bottom. The reset mechanism 106 can be moved by a user between a set and a reset position. In the set position, the combination for the unlocked position of the locking mechanism 102 that was previously selected is fixed. In one embodiment, the reset mechanism 106 can only be moved to the reset position by the user when the combination is displayed on the wheels. In the reset position, the reset mechanism allows the wheels to be moved to a new combination that will unlock the locking mechanism. When the reset mechanism 106 is returned to the set position, the new combination is established and may be used to place the locking mechanism 102 in the unlocked position. FIG. 3 shows the reset mechanism 106 as a rotatable dial. However, the reset mechanism may have various embodiments including, but not limited to, a button, a lever, a switch, or other suitable resetting mechanism. It should also be noted that alternative embodiments may include a reset mechanism that does not require the locking device to display the combination for the reset mechanism to be manipulated to the reset position, e.g., lock and key mechanisms.

Figure 15A:
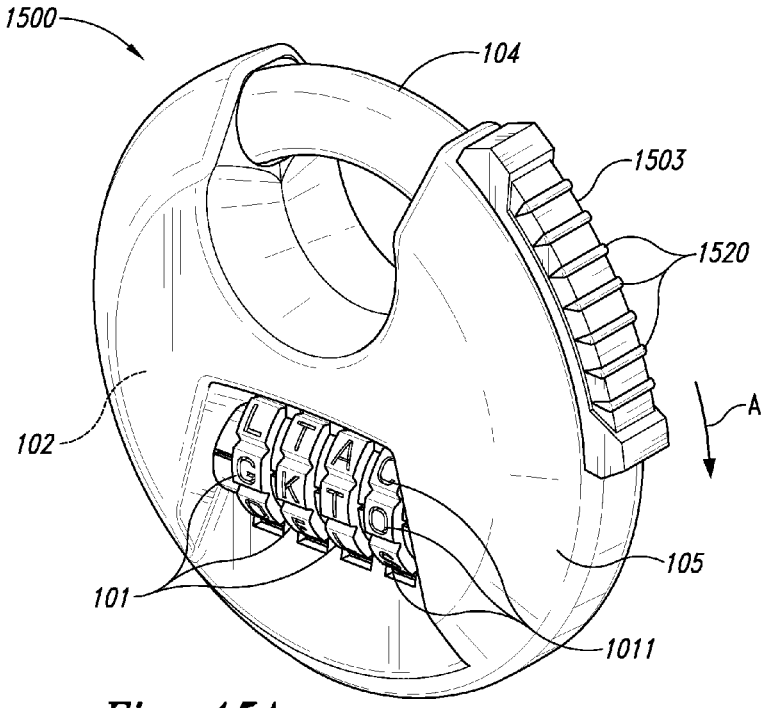
FIGS. 15A and 15B are isometric views of a combination discus lock in a closed configuration and an open configuration, respectively, in accordance with another embodiment of the present disclosure.
Figure 15B:
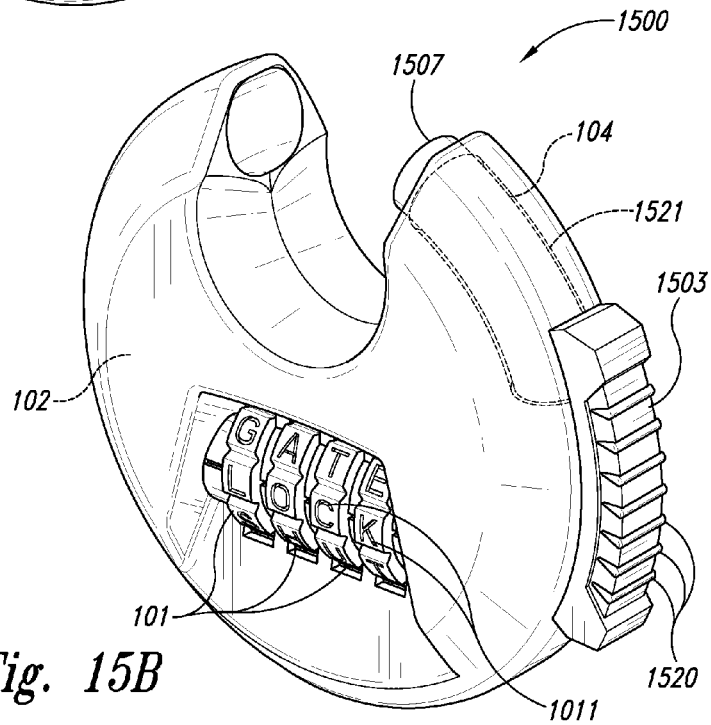

FIGS. 15A and 15B are isometric views illustrating a combination discus lock device 1500 ("lock device 1500") in a closed configuration and an open configuration, respectively, in accordance with an embodiment of the present disclosure. The lock device 1500 includes features generally similar to those of the lock device 100 described above with reference to FIGS. 1-7. For example, referring to FIGS. 15A and 15B together, the lock device 1500 can include the locking mechanism 102 positioned within the lock housing 105 and the shackle 104 movable between the closed position (FIG. 15A) and the open position (FIG. 15B). The lock device 1500 also includes the rotatable wheels 101 or other engagement members that can be manipulated by a user to align the indicia 1011 across the lock housing 105 and display a combination (e.g., "LOCK"). In other embodiments, the lock device 1500 can include more or less than four wheels 101 that can be manipulated by the user to enter and display the unlocking combination.

When the combination is displayed, the locking mechanism 102 can move from a locked configuration to an unlocked configuration and, as explained in further detail below, can permit a slider actuator 1503 to drive the shackle 104 from the closed position to the open position. The slider actuator 1503 can be operably coupled to the locking mechanism 102 and to the shackle 104. Rather than a lever actuator (e.g., the lever 103 of FIG. 1) that pivots with respect to the lock housing 105, the slider actuator 1503 slides or otherwise moves along an outer surface of the lock housing 105 in the direction of an arrow A from a first position (FIG. 15A) to a second position (FIG. 15B) to drive the shackle 104 from the closed position (FIG. 15A) to the open position (FIG. 15B). In other embodiments, the first and second positions can be reversed such that the slider actuator 1503 moves in the opposite direction of the arrow A (FIG. 15A) to open the shackle 104.

In the illustrated embodiment, the slider actuator 1503 is positioned on the circumference of the lock housing 105 and therefore slides or otherwise moves along a curved path between the first and second positions. In other embodiments, however, the slider actuator 1503 can be positioned on other outer surfaces of the lock housing 105. For example, the slider actuator 1503 can be positioned on the front surface or the back surface of the lock housing 105 and slide along a linear path to move the shackle 104.

As shown in FIGS. 15A and 15B, the slider actuator 1503 can be an elongated member and can include a plurality of protrusions 1520, indents, and/or other gripping features that allow the user to more easily manipulate the slider actuator 1503. In other embodiments, the slider actuator 1503 can include a protruding tab and/or other suitable handles that can be pushed, pulled, or otherwise manipulated to drive the shackle 104 between the open and closed positions. The slider actuator 1503 can be made from metals (e.g., die cast metals), metal alloys, polymers, and/or other suitable materials.

When the locking mechanism 102 is oriented in the locked configuration (e.g., when the combination is not displayed on the wheels 101 as in FIG. 15A), the locking mechanism 102 restricts the slider actuator 1503 from moving the shackle 104. For example, the slider actuator 1503 can be blocked from moving to the second position until the combination is displayed on the wheels 101. In other embodiments, the slider actuator 1503 can move freely between the first and second positions, but does not engage and move the shackle 104 to the open position until the combination is displayed on the wheels 101.

A user can manipulate the wheels 101 to enter and display the combination (e.g., "LOCK") such that the locking mechanism 102 moves to the unlocked configuration. This allows the slider actuator 1503 to move to the second position and drive the shackle 104 to the open position. As shown in FIG. 15B, in the open position, a free end 1507 of the shackle 104 can be released from the lock housing 105 and the shackle 104 can be drawn along an internal channel 1521 into the lock housing 105. In other embodiments, moving the slider actuator 1503 releases the free end 1507 of the shackle 104 and allows it to pivot with respect to the lock housing 105 rather than drawing it into the lock housing 105.

Figure 16:
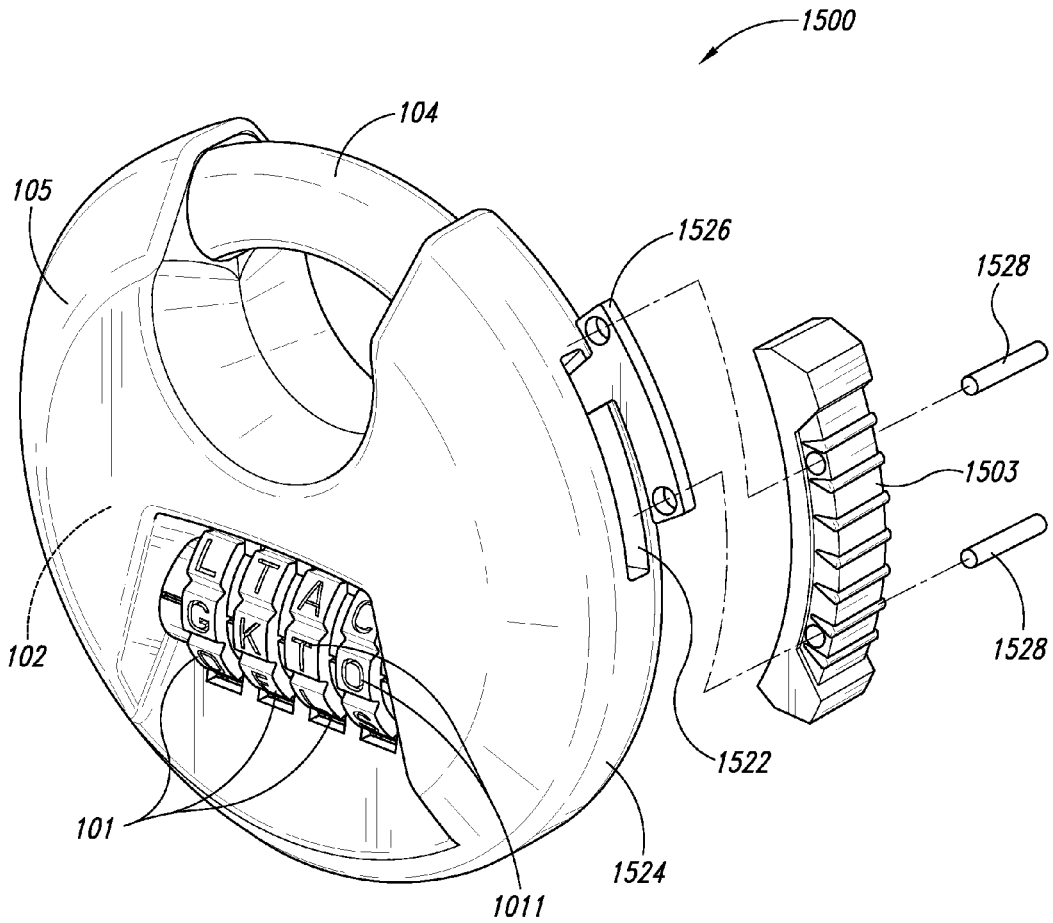
FIG. 16 is a partially exploded isometric view of the combination discus lock of FIGS. 15A and 15B.

FIG. 16 is a partially exploded view of the lock device 1500 of FIGS. 15A and 156 illustrating features underlying the slider actuator 1503. As shown in FIG. 16, the lock housing 105 can include a slot 1522 extending through a sidewall 1524 of the lock housing 105, and the lock device 1500 can further include a bracket 1526 protruding through the slot 1522. An end portion (not shown) of the bracket 1526 positioned within the lock housing 105 can be operably coupled to the locking mechanism 102 and to the shackle 104 (e.g. via screws, pins, adhesives, and/or other suitable fasteners). The protruding end portion of the bracket 1526 can be coupled to the slider actuator 1503 using pins 1528, screws, adhesives, and/or other suitable fastening mechanisms or techniques. In other embodiments, the slider actuator 1503 and the bracket 1526 can be integrally formed. In various embodiments, the slot 1522 can be in communication with the internal channel 1521 (FIG. 156) such that the bracket 1526 can couple directly the slider actuator 1503 to the shackle 104. In further embodiments, the slot 1522 can be positioned elsewhere on the lock housing 105 that allows the bracket 1526 to operably couple the locking mechanism 102, the shackle 104, and the slider actuator 1503 together. The bracket 1526 and the pins 1528 can be made from metal, metal alloy (e.g., stainless steel), plastic, and/or other materials suitable for use to drive the movement of the shackle 104.

As further shown in FIG. 16, the slider actuator 1503 can be longer (e.g., twice as long) as the slot 1522 such that the slider actuator 1503 covers the slot 1522 as it moves between the first and second positions. This blocks debris from entering and interfering with the internal mechanisms of the lock housing 105 (e.g., the locking mechanism 102).

When the locking mechanism 102 is in the unlocked configuration, moving the slider actuator 1503 from the first position to the second position drives the underlying bracket 1526*s* which in turn withdraws the free end 1507 (FIG. 15B) of the shackle 104 from engagement with the lock housing 105 and, in various embodiments, draws the shackle 104 into the internal channel 1521 (FIG. 15B) of the lock housing 105. As discussed above, in other embodiments, moving the slider actuator 1503 can drive the bracket 1526 to release the free end 1507 of the shackle 104 and allow it to move away from the lock housing 105 to the open position.

Figure 17:
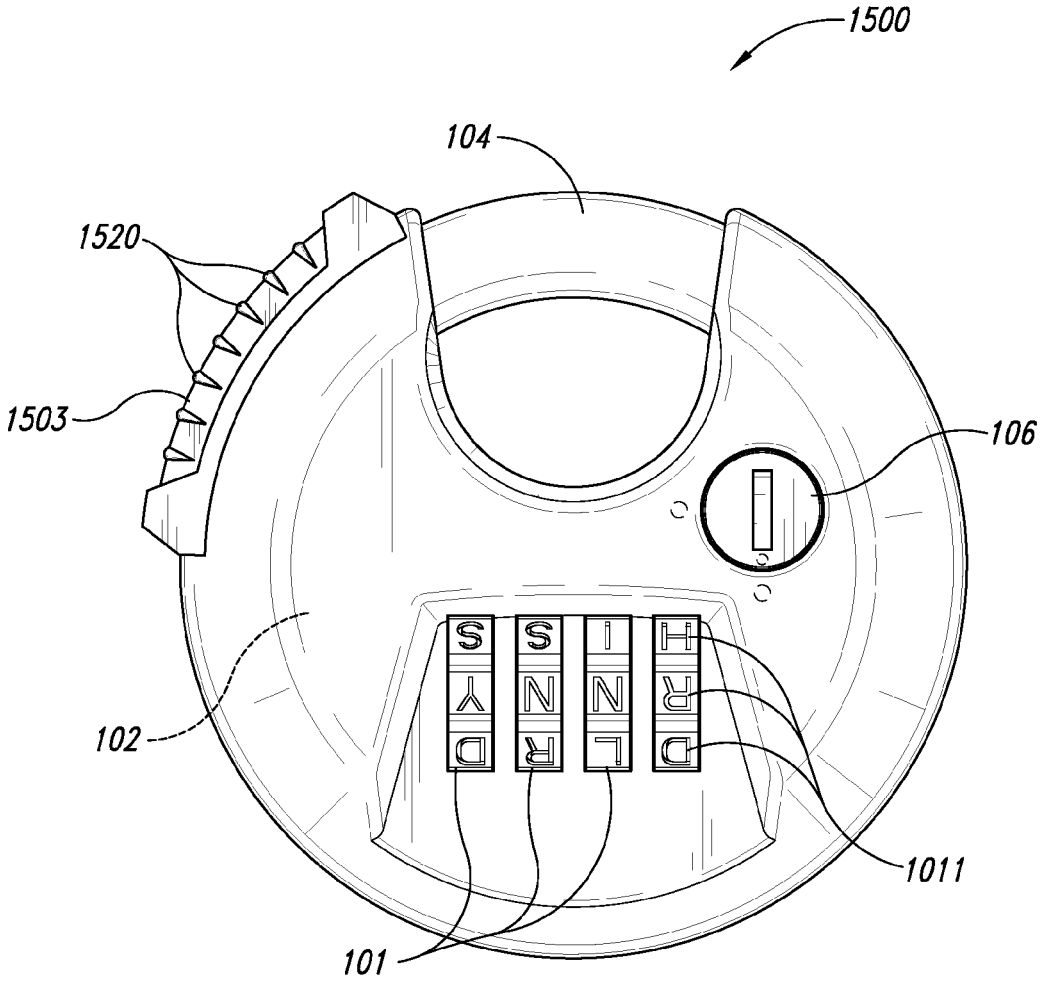
FIG. 17 is a back view of the combination discus lock of FIG. 15A.

FIG. 17 is a back view of the lock device 1500 of FIGS. 15A-16. As shown in FIG. 17, in various embodiments, the lock device 1500 can include the keyless reset mechanism 106. As described above with reference to FIG. 3, the reset mechanism 106 can be manually moveable between set and reset positions when the combination is displayed to allow a user to change the combination of the lock device 1500.

From the foregoing, it will be appreciated that specific embodiments of the invention have been described herein for purposes of illustration, but that various modifications may be made without deviating from the invention. Additionally, aspects of the invention described in the context of particular embodiments or examples may be combined or eliminated in other embodiments. For example, the locking devices shown in the Figures include a shackle, but in other embodiments the locking devices can include other types of locking members, such as chains, chords, etc. Additionally, FIGS. 1-17 illustrate a discus-shaped lock housing 105. However, in other embodiments, the lock housing 105 can have other suitable shapes, such square, rectangular, oval, etc. Although advantages associated with certain embodiments of the invention have been described in the context of those embodiments, other embodiments may also exhibit such advantages. Additionally, not all embodiments need necessarily exhibit such advantages to fall within the scope of the invention. Accordingly, the invention is not limited except as by the appended claims.

We claim:

1. A combination lock device, comprising:

a lock housing:

a locking mechanism positioned at least partially within the lock housing, wherein the locking mechanism has a locked configuration and an unlocked configuration;

rotatable engagement members moveable relative to the lock housing, the engagement members being configured to display a combination, wherein the locking mechanism is in the unlocked configuration when the combination is displayed, and wherein the locking mechanism is in the locked configuration when the combination is not displayed and the housing has a recessed area in a front portion of the housing, and the engagement members are disposed in the recessed area, the recessed area being sized to allow a user to manually engage and move the engagement members;

a shackle having a closed position wherein the shackle is releasably engaged within the lock housing and an open position wherein the shackle is released and moveable relative to the housing;

a slider actuator operably coupled to the shackle, the slider actuator being slideable relative to the housing between a first position and a second position spaced apart from the first position, wherein moving the slider actuator to the second position when the locking mechanism is in the unlocked configuration moves the shackle from the closed position to the open position, wherein the lock housing includes a sidewall having a slot with a bracket projecting through the slot and coupling the slider actuator to the shackle, and the slider actuator has a length at least twice as long as a length of the slot.

2. A combination lock device, comprising:

a discus lock housing with a sidewall having a slot;

a locking mechanism positioned at least partially within the lock housing, wherein the locking mechanism has a locked configuration and an unlocked configuration;

a plurality substantially coaxially aligned rotatable engagement members moveable relative to the lock housing, the engagement members being configured to display a combination, wherein the locking mechanism is in the unlocked configuration when the combination is displayed, and wherein the locking mechanism is in the locked configuration when the combination is not displayed;

a shackle having a closed position wherein the shackle is releasably engaged within the lock housing and an open position wherein the shackle is released and moveable relative to the housing;

a slider actuator operably coupled to the shackle by a bracket which projects through the slot, the slider actuator being slideable relative to the housing between a first position and a second position spaced apart from the first position, wherein moving the slider actuator to the second position when the locking mechanism is in the unlocked configuration moves the shackle from the closed position to the wen position;

the slider actuator is positioned over the slot and has a length at least two times that of a length of the slot.

3. A combination discus lock device, comprising:

a discus lock housing;

a locking mechanism, positioned at least partially within the housing and having a locked position and an unlocked position;

a plurality of engagement members moveable relative to the housing, the engagement members including indicia thereon and being configurable to display with the indicia a combination to unlock the locking mechanism, when the combination is displayed the locking mechanism is moveable from the locked position to the unlocked position, and when the combination is not displayed the locking mechanism is blocked from moving to the unlocked position, wherein the housing has a recessed area in a front portion of the housing, and the engagement members are disposed in the recessed area, the recessed area being sized to allow a user to manually engage and move the engagement members;

a shackle connected to the housing and being moveable relative to the housing between open and closed positions, the shackle being movable to the open position when the locking mechanism is in the unlocked position and when the combination is displayed, and the shackle being retained in the closed position when the locking mechanism is in the locked position; and a slider actuator operably coupled to the shackle, the slider actuator being slideable relative to the housing between a first position and a second position spaced apart from the first position, wherein moving the slider actuator to the second position when the locking mechanism is in the unlocked position moves the shackle from the closed position to the open position.

4. The combination discus lock device of claim 3 wherein the engagement members are wheels, each wheel having a plurality of indicia thereon.

5. The combination discus lock device of claim 3 further comprising a keyless reset mechanism manually moveable between set and reset positions, when the reset mechanism is in the set position, the combination for unlocking the locking mechanism is a first combination, when the reset mechanism is in the reset position, the combination to unlock the locking mechanism can be changed from the first combination to a second combination different than the first combination.

6. The combination discus lock device of claim 5 wherein the keyless reset mechanism is moveable from the set position to the reset position when the engagement members display the combination and when the locking mechanism is in the unlocked position.

7. The combination discus lock device of claim 6 wherein the keyless reset mechanism is blocked from moving from the set position to the reset position when the locking mechanism is in the locked position.

8. The combination discus lock device of claim 3 further comprising a keyless reset mechanism, at least a portion of the keyless reset mechanism being exterior of the housing and manually moveable between a combination set position and a combination reset position.

9. A combination discus lock, comprising:

a discus lock body having a front portion, a rear portion opposite the front portion, a side wall at the periphery of the lock body, a slot in the side wall communicating with the interior of the lock body, and a recess in the front portion of the lock body and a plurality of apertures in the recess;

a locking mechanism positioned at least partially within the body and being movable between a locked configuration and an unlocked configuration;

a plurality of wheels each individually rotatable with respect to the body, the plurality of wheels being coaxially aligned, at least a first portion of the wheels being contained within the body, a second portion of the wheels protruding through the apertures in the recess in the body, the wheels being manually engageable by a user for rotation of the wheels;

a plurality of indicia sets corresponding to the plurality of wheels, wherein the wheels are configured to display a combination, and wherein the locking mechanism is moveable from the locked to the unlocked configuration when the combination is displayed;

a shackle at least partially disposed in the lock body and being movable relative to the lock body between an open position and a closed position; and a slider actuator disposed on the side wall of the lock body and connected to the shackle through the slot, the slider actuator being manually moveable relative to the lock body between first and second positions when the combination is displayed, the slider actuator causing the shackle to move from the closed position to the open position when the combination is displayed and when the slider actuator is moved from the first position to the second position.

10. The combination discus lock of claim 9 further comprising a keyless reset mechanism manually moveable between set and reset positions, when the keyless reset mechanism is in the set position the combination for unlocking the locking mechanism is a first combination, when the reset mechanism is in the reset position the combination to unlock the locking mechanism can be changed from the first combination to a second combination different than the first combination.

* * * * *